US008330341B2

(12) United States Patent
Linow et al.

(10) Patent No.: US 8,330,341 B2
(45) Date of Patent: Dec. 11, 2012

(54) COMPACT UV IRRADIATION MODULE

(75) Inventors: Sven Linow, Darmstadt (DE); Ralf Pretsch, Hanau (DE); Thomas Arnold, Bessenbach (DE)

(73) Assignee: Heraeus Noblelight GmbH, Hanau (DE)

( * ) Notice: Subject to any disclaimer, the term of this patent is extended or adjusted under 35 U.S.C. 154(b) by 86 days.

(21) Appl. No.: 12/999,255

(22) PCT Filed: Jun. 15, 2009

(86) PCT No.: PCT/EP2009/004296

§ 371 (c)(1),
(2), (4) Date: Dec. 15, 2010

(87) PCT Pub. No.: WO2010/003511

PCT Pub. Date: Jan. 14, 2010

(65) Prior Publication Data

US 2011/0163651 A1 Jul. 7, 2011

(30) Foreign Application Priority Data

Jun. 16, 2008 (DE) ..... 10 2008 028 233

(51) Int. Cl.
*H01J 5/16* (2006.01)

(52) U.S. Cl. ..... 313/113; 313/114; 313/115

(58) Field of Classification Search ..... 313/113, 313/114, 115

See application file for complete search history.

(56) References Cited

U.S. PATENT DOCUMENTS

| | | | |
|---|---|---|---|
| 7,947,335 | B2 | 5/2011 | Werdecker et al. |
| 2002/0017845 | A1 | 2/2002 | MacLennan et al. |

FOREIGN PATENT DOCUMENTS

| | | | |
|---|---|---|---|
| CA | 2575799 | A1 | 3/2006 |
| DE | 10 2005 016 732 | A1 | 10/2006 |
| DE | 102006062166 | A1 | 6/2008 |
| JP | 3702850 | B2 | 7/2005 |
| KR | 10-2007-0054686 | A | 5/2007 |
| WO | 2006021416 | A1 | 3/2006 |

OTHER PUBLICATIONS

Office Action Issued Jan. 13, 2009 in German Appln. Ser. No. 10 2008 028 233.2.

Office Action issued Jan. 16, 2012 in KR Application No. 10-2010-7027992.

Int'l Search Report issued Jan. 22, 2010 in Int'l Application No. PCT/EP2009/004296; Written Opinion.

*Primary Examiner* — Vip Patel

(74) *Attorney, Agent, or Firm* — Panitch Schwarze Belisario & Nadel LLP

(57) ABSTRACT

A module is provided for irradiation of at least one substrate. The module includes an irradiation unit for irradiating the substrate with ultraviolet light, wherein the irradiation unit has a discharge lamp with an integrated reflector. A method is also provided for producing an irradiation module for irradiating a substrate using UV light, wherein the reflector is coated on the discharge lamp.

13 Claims, 3 Drawing Sheets

COMPACT UV IRRADIATION MODULE

CROSS-REFERENCE TO RELATED APPLICATIONS

This application is a Section 371 of International Application No. PCT/EP2009/004296, filed Jun. 15, 2009, which was published in the German language on Jan. 14, 2010, under International Publication No. WO 2010/003511 A2 and the disclosure of which is incorporated herein by reference.

BACKGROUND OF THE INVENTION

The invention relates to a module for generating UV light for irradiating a substrate.

Discharge lamps for generating radiation, in particular for the targeted generation of UV radiation, are already known from the prior art. The doping of the gas filling, in order to attain a targeted effect on the shape of the emission spectrum and thus to optimize the lamp for different applications, is also described in various publications. Such lamps can be constructed as low-pressure emitters, medium-pressure emitters, or high-pressure emitters, and via the pressure under which the discharge takes place during operation, both the spectrum and the power are influenced with respect to the volume of the discharge.

However, even with optimally doped discharge lamps operating in the optimum pressure range, only a portion of the emitted radiation is used for the desired process, since spectra of discharge lamps always also contain components in the visible or in the infrared range, and because a portion of the power heats up the envelope tube and this tube itself radiates in the far infrared. The portions of the spectrum of the emitted radiation that are harmful or undesired for the process are often removed from the spectrum of the overall radiation by a filter.

Such discharge lamps or the discharges used as radiation sources radiate in all spatial directions, so that at least in the radial direction only a negligible dependency of the emitted intensity on the angle between the lamp and substrate exists.

In order to attain the most efficient use possible of the emitted radiation, among other things the radiation emitted uniformly in all directions from the lamp is deflected by reflectors onto, for example, a substrate. Here, spectrally wide-band, specular reflectors do not provide good efficiency (that is, high reflectivity) for UV, because metals exhibit a high absorption and ceramics are either still transparent or likewise exhibit a high absorption. Specular reflection is understood to be reflection on an essentially smooth surface, whereby the angular information of the radiation is preserved.

Since simple material boundary faces other than in the visible (Ag, Al) or infrared (nearly all metals) are not available as efficient reflectors, dielectric reflectors are used made of transmissive materials having layer sequences of varying indices of refraction. Such reflectors have only a limited bandwidth within which they actually reflect. Therefore, they can also be used as a filter. The production of such reflectors is expensive, because a plurality of different layers must be deposited on a high-quality, polished carrier.

Because the reflective area of a dielectric reflector depends on the angle under which the light is incident on the reflector, such reflectors must be designed for the geometric situation under which they are operated. In order to obtain a reasonably homogeneous reflectivity across the surface being used, this must be arranged at a constant angle relative to the radiation source. The reflector must be mounted at a not too small distance from the light source, because the radiation emitted from the lamp is not from a punctiform origin, but instead originates from the entire surface area of the discharge and is thus incident at different angles on the reflector, but for a high efficiency, great variations in angles at which the radiation is incident on the reflector are not permissible.

The continuous operation of such reflectors is expensive, because these usually must be cooled—they are optimized for high reflectivity in the UV or VIS and therefore strongly absorb outside of their reflective, spectral ranges. Compact installations are therefore typically water-cooled, which is associated with high costs and with expensive constructions.

Modules for UV or VIS radiation, that is, housings in which radiation sources, reflectors, and optionally shutters are housed, always consist of a plurality of components and typically require water for cooling the reflector and the shutter. Only units of very low power can have an air-cooled construction. Such a module is described, for example, in International patent application publication No. WO 2005/105448 as prior art. German utility model DE 20 2004 006 274 U1 gives an example of the difficulties of how a flashlight can be extremely compactly and easily constructed. For this purpose, an external reflector must be selected. The power of the lamp is only very low, so that the use of very large dimensioned cooling by air prevents an overheating of the lamp and the reflector. From this it follows that the system has disproportionately large dimensions, in comparison with the dimensions of the actual light source, and thus consists of a plurality of single parts.

Decisive for a long service life and thus high utility for the user of UV lamps is furthermore the temperature of the pinching of the emitter and the lamp tube. The temperature of the pinching should not exceed 300° C., but the lamp tube can exhibit significantly higher temperatures, so that additional measures are necessary for the separate cooling of the pinched regions for lamps of higher power densities.

German patent document DE 33 05 173 shows how it is possible to design purely air-cooled devices by use of complex flow channels and the use of lamps having low power densities. The power density is defined as the power/length of the discharge.

The above-mentioned modules are all rather complex and expensive in their configuration or can emit only low power/device volume.

BRIEF SUMMARY OF THE INVENTION

An object of the invention is therefore to provide a simple and compact module for generating UV or VIS radiation by a discharge lamp. Here, a plurality of components should be eliminated, so that the structural size and expense for production and assembly, maintenance, etc. are significantly reduced.

This object is achieved according to the invention by a module for generating UV radiation for the irradiation of a substrate, comprising an irradiation device, wherein the irradiation device has a discharge lamp with an integrated reflector made of quartz glass, provides that the reflector is arranged as part of the discharge lamp.

The reflector is thus located as part of a discharge lamp, which has the result that radiation from the lamp itself can be output in a directed way. Here, the position and the orientation of the reflector can be adapted so that the radiation is emitted essentially only in the desired directions.

Such a device having an integrated reflector across 180° periphery of the lamp tube shows that, for elongated lamps, on the front side of the discharge lamp, nearly two-times the amount of radiation is emitted. On the back side, less than 25% of the radiation compared with an uncoated emitter or an uncoated discharge lamp is achieved. Here, the radiation power integrated over the entire spectral range is considered.

Such an arrangement of a reflector as part of the discharge lamp has the effect that the rear reflector, which is normally arranged in such devices for the irradiation, can be eliminated or a simplification of the water cooling normally arranged there can be performed. Thus, cooling is performed preferably by convection in a simpler way and has the result that finally also the installation space is reduced and a reduction to a minimal and compact module is realized. If another external reflector is attached, then significantly less radiation power would likewise occur there.

In one advantageous embodiment, the invention provides that the reflector comprises a coating made of opaque quartz glass. Such a coating allows the integration of a wide-band reflector of UV-C up to FIR, even in the wavelength range of 200 nm to 3000 nm, and effectively allows the entire radiation emitted from the discharge through the irradiation tube to be output in a directed way.

Advantageously, the coating comprises synthetic quartz glass, which achieves an especially effective UV reflection due to its reduced UV absorption.

For UV-generating systems, it is also conceivable to use a solarization-resistant quartz glass both for the lamp tube and also for the opaque reflector.

With sufficient layer thickness, such a coating made of opaque quartz glass reflects nearly the entire radiation in the UV and VIS, and also in the IR. However, because the reflector made of this material becomes hot during operation of the lamp and itself emits thermal radiation above approximately 3000 nm and especially strongly above approximately 4500 nm, the radiation output at the back is almost purely infrared starting at approximately 2500 nm. Surprisingly, the opaque reflector thus additionally acts as a useful filter.

In one preferred embodiment, the invention provides that mercury medium-pressure emitters are used as lamps and mercury medium-pressure emitters are used in a short-arc embodiment. However, it is possible to apply the invention just as well for low-pressure emitters or high-pressure emitters, as well as for all general-use UV lamps.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
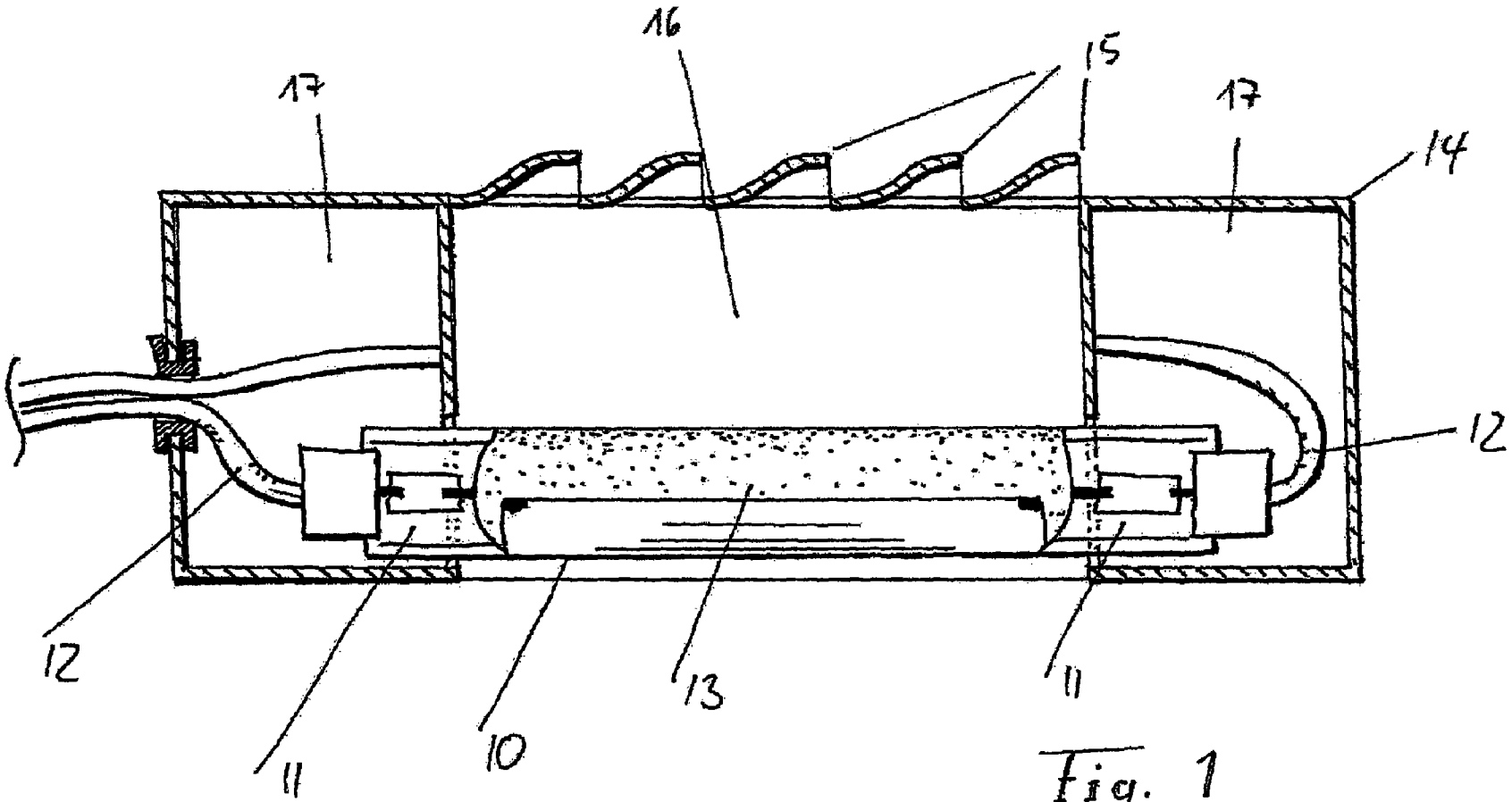
FIG. 1 is a schematic longitudinal sectional view of a compact irradiation module according to an embodiment of the invention without a filter.

FIG. 1 shows in longitudinal section a module according to an embodiment of the invention having passive convective cooling of the lamp body. Inside the module, the UV lamp (10) is arranged with its pinched regions (11) and the current feeds (12). On the lamp body, a reflector (13) made of opaque quartz is directly deposited. The lamp is mounted in a housing (14), which is cooled purely by convective air flow. Here, the housing (14) is divided into different regions. The middle region (16) is constructed as a shaft, which is covered in the figure with a plate (15) for limiting stray UV radiation, with outflow openings for the rising hot air being stamped into this plate. The openings for diverting the hot air are shown as one especially simple possibility. In the scope of usual inventive activity, technical solutions for diversion of the air can be found that permit a better shading of the (harmful) UV radiation and simultaneously permit good convection.

The invention is therefore not limited to the simple variant with a plate (15), but instead also more complex constructions of the shaft (16) and covering (15) of the stray radiation, such as planar or folded covers, are included here in the scope of usual inventive activity. Here, the geometry results from the requirement of achieving the most continuous and fastest convective flow possible, that is achieved in particular for stopping the discharge of stray radiation in tall shafts, where this is structurally required, and simultaneously keeping the structural size as small as possible. The partitions (17) serve for sealing off pinched regions and current supply, as well as the not-shown mechanical holder of the lamp; they can be actively cooled separately.

Figure 2:
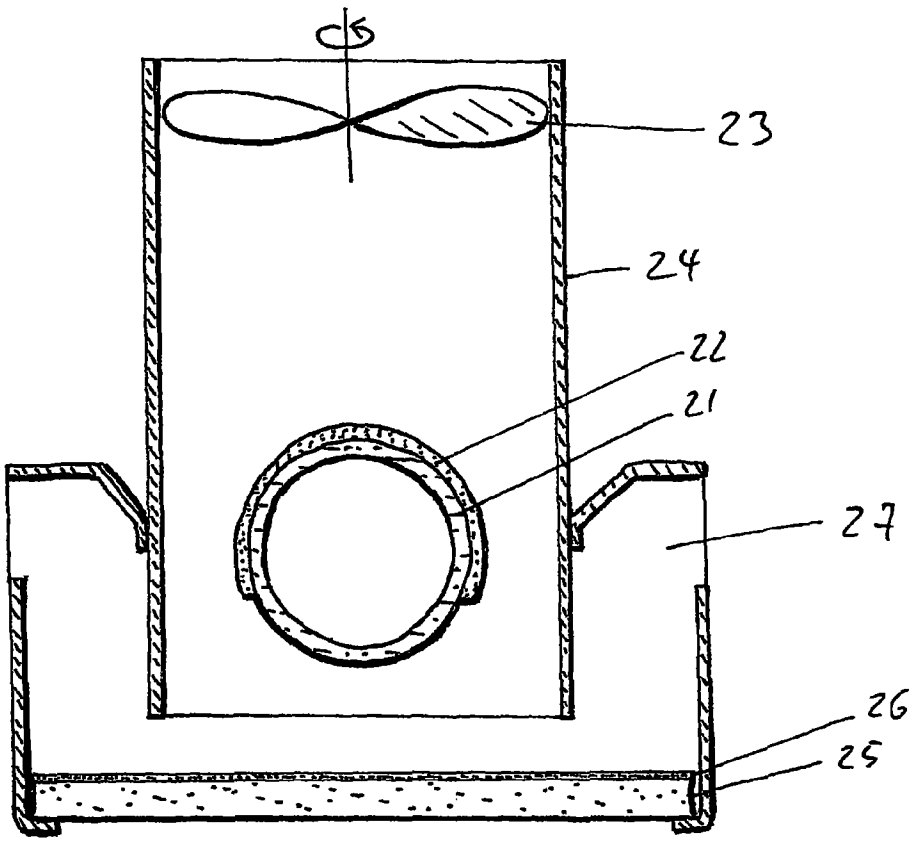
FIG. 2 is a schematic transverse sectional view of a discharge lamp according to an embodiment of the invention with an added filter.

In FIG. 2 the cross section through a module according to the invention is shown with active convective cooling of the lamp body. On the lamp tube (21) a reflector (22) made of opaque quartz is applied, which surrounds more than 180°, in order to let as little radiation as possible strike the module housing (24). A ventilator (23) is arranged that serves for active cooling. An axial ventilator is shown, which can be used to produce both negative and also positive pressure. It is conceivable that radial ventilators or compressors with compressed air or the like—thus devices that actively generate an air flow—are used as alternative solutions. These ventilators can now supply either cold air, which is guided past the lamp tube (21) through the shaft (24) against a window (25) and is discharged from the module again from discharge openings (27), or the ventilator draws air via the openings (27). A functional layer (26), which as an additional reflection layer allows transmission of only certain portions of the radiation, is additionally applied to the window (25). The functional layer (26) could, however, also be omitted. The window (25) is preferably made of a UV-transmitting material, such as quartz glass; the reflector can also be constructed from several dielectric or metallic layers.

The shown construction should clarify the inventive principle. However, other arrangements of channels and ventilators are also useful and included.

In addition, a shutter, which quickly shades the radiation, can be mounted in front of the window. In principle, the disk could also be replaced by a hollow body made of UV-transparent glass that carries a flow of water and serves as an IR filter and at the same time has a very cold surface.

Figure 3:
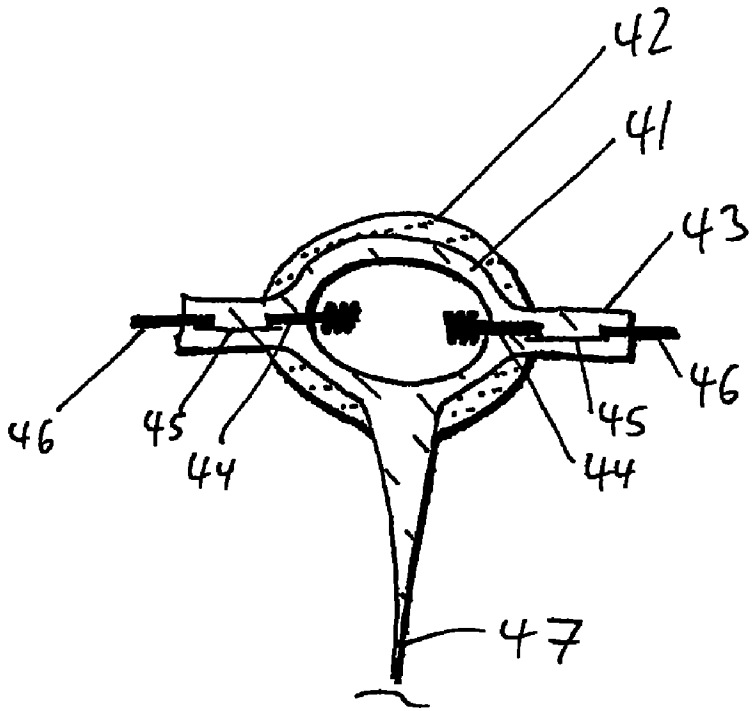
FIG. 3 is a schematic transverse sectional view of an emitter according to an embodiment of the invention for direct coupling into an optical waveguide.

FIG. 3 shows a further device according to the invention, in which UV radiation from a discharge lamp is coupled directly into an optical fiber. The lamp body (41) made of quartz glass is almost completely encased with a reflective coating made of opaque quartz glass (42). The pinched regions (43) close the glass bulb (41), molybdenum foils (45) are sealed gas-tight in the pinched regions (43), with external, conductive pins (46) for supplying the electrical current and internal electrodes (44) being welded to these foils. The bulb is provided with a tapering element (47) made of quartz glass, in which a large part of the radiation from the lamp bulb is discharged and from which the radiation cannot escape due to total reflection at the surface. This element is connected to the actual optical fiber by a suitable coupling element, which, however, is not shown in the figure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A module for generating UV radiation for the irradiation of a substrate, the module comprising:

a housing;

an irradiation device arranged within the housing and having a discharge lamp with an integrated reflector made of quartz glass, wherein the reflector is arranged on an outer surface of the discharge lamp; and a cooling system configured to promote convective air flow through at least a portion of the housing.

2. The module according to claim 1, wherein the reflector comprises a coating made of opaque quartz glass.

3. The module according to claim 2, wherein the coating comprises synthetic quartz glass.

4. The module according to claim 1, wherein the reflector is a wide-band reflector.

5. The module according to claim 1, wherein the discharge lamp is a UV lamp.

6. The module according to claim 1, wherein the discharge lamp is a mercury medium-pressure emitter.

7. The module according to claim 1, wherein the discharge lamp is a low-pressure emitter.

8. The module according to claim 1, wherein the discharge lamp is a high-pressure emitter.

9. A method for production of a module according to claim 1, wherein the reflector is applied as a coating on the discharge lamp of the irradiation module.

10. The module according to claim 1, wherein the cooling system comprises a plate disposed at a top side of the housing, the plate including a plurality of outflow openings.

11. The module according to claim 1, wherein the cooling system comprises a ventilator and one or more openings in the housing.

12. The module according to claim 11, wherein the ventilator is configured to supply cold air that is discharged through the one or more openings in the housing.

13. The module according to claim 11, wherein the ventilator is configured to draw air into the housing via the one or more openings.

* * * * *